US006448216B1

(12) United States Patent
Wolf et al.

(10) Patent No.: US 6,448,216 B1
(45) Date of Patent: Sep. 10, 2002

(54) ABRASIVE COMPOSITIONS INCLUDING CULLET

(75) Inventors: Ann Marie Alia Wolf, Tucson, AZ (US); Richard Winston Adlai Garb, Littleton, CO (US); Jennifer Lou Lindquist, Redding, CA (US)

(73) Assignee: Sonora Environmental Research Institute, Inc., Tucson, AZ (US)

( * ) Notice: Subject to any disclaimer, the term of this patent is extended or adjusted under 35 U.S.C. 154(b) by 0 days.

(21) Appl. No.: 09/871,091

(22) Filed: May 31, 2001

(51) Int. Cl.[7] ..... C11D 3/14

(52) U.S. Cl. ..... 510/395; 510/139; 510/268; 510/368; 510/470; 510/511; 510/507; 510/236; 510/240

(58) Field of Search ..... 510/139, 268, 510/395, 368, 470, 511, 507, 236, 240

(56) References Cited

U.S. PATENT DOCUMENTS 1,965,299 A * 2/1934 Patterson ..... 51/280
4,155,870 A * 5/1979 Jorgensen ..... 252/131
4,716,690 A * 1/1988 Szucs ..... 51/321
5,484,548 A * 1/1996 Kiewert et al. ..... 252/179.17
5,605,491 A * 2/1997 Yam et al. ..... 451/40
5,637,029 A * 6/1997 LEhane ..... 451/39
5,821,184 A * 10/1998 Haines et al. ..... 501/39

OTHER PUBLICATIONS

VanBuskirk, Fast Blast Abrasive, Feb. 8, 2000, Universal Ground Cullet Inc., Material Safety Data Sheet.*

* cited by examiner

*Primary Examiner*—Charles Boyer
(74) *Attorney, Agent, or Firm*—Gavin J. Milczarek-Desai; Durando Bridwell & Janke, P.L.C.

(57) ABSTRACT

New abrasive cleaner products that utilize different types of glass cullet, such as container, ceramic, or plate glass, for scouring applications is provided. Preferably, the invention utilizes recycled container-glass cullet and also includes a sugar-based surfactant, a filler, and a preservative in combination with cullet to provide effective abrasive cleaner compositions.

22 Claims, 4 Drawing Sheets

| SCRATCH TESTING - PURE SUBSTANCE | | | | | | | | |
|---|---|---|---|---|---|---|---|---|
| Rating (0-10 with 0 representing no change in surface) | | | | | | | | |
| | | | | | | | | |
| **Surface** | **200 C** | **200 S** | **270 C** | **270 S** | **400 C** | **400 S** | **-400 C** | **-400 S** |
| Copper | 2.5 | 7 | 3 | 4 | 3 | 5 | 0 | 6 |
| Floor Tile | 0 | 1.5 | 0 | 0.5 | 0 | 2 | 0 | 2 |
| Formica - textured matte finish | 0 | 2.5 | 0 | 2 | 0 | 2 | 0 | 3 |
| Formica - smooth glossy finish | 0 | 2 | 0 | 2 | 0 | 2 | 0 | 2 |
| Glass | 0 | 0.5 | 0 | 1 | 0 | 0 | 0 | 0 |
| Glazed Ceramic Tile | 0 | 0 | 0 | 0 | 0 | 0 | 0 | 0 |
| Linoleum - textured glossy finish | 0.5 | 1 | 0.5 | 1 | 0.5 | 1 | 0.5 | 1 |
| Plastic light switch cover | 1 | 3 | 1 | 3 | 1 | 2 | 0.5 | 1 |
| Stainless Steel | 2 | 7 | 3 | 8 | 0.5 | 7 | 4 | 9 |
| Wood painted with Latex paint | 3 | 5 | 4 | 4 | 4 | 5 | 2 | 3 |
| *AVERAGE* | *0.9* | *3.0* | *1.2* | *2.6* | *0.9* | *2.6* | *0.7* | *2.7* |
| *AVERAGE w/o painted wood* | *0.7* | *2.7* | *0.8* | *2.4* | *0.6* | *2.3* | *0.6* | *2.7* |
| | | | | | | | | |
| **CULLET** | | | | | | | | |
| **Surface** | **200 C** | **250 C** | **270 C** | **400 C** | **-400 C** | | | |
| Copper | 2.5 | 3 | 3 | 3 | 0 | | | |
| Floor Tile | 0 | 0 | 0 | 0 | 0 | | | |
| Formica - textured matte finish | 0 | 0 | 0 | 0 | 0 | | | |
| Formica - smooth glossy finish | 0 | 0 | 0 | 0 | 0 | | | |
| Glass | 0 | 0 | 0 | 0 | 0 | | | |
| Glazed Ceramic Tile | 0 | 0 | 0 | 0 | 0 | | | |
| Linoleum - textured glossy finish | 0.5 | 1 | 0.5 | 0.5 | 0.5 | | | |
| Plastic light switch cover | 1 | 0.5 | 1 | 1 | 0.5 | | | |
| Stainless Steel | 2 | 1 | 3 | 0.5 | 0.5 | | | |
| Wood painted with Latex paint | 3 | 3 | 4 | 4 | 2 | | | |
| *AVERAGE* | *0.9* | *0.9* | *1.2* | *0.9* | *0.4* | | | |
| *AVERAGE w/o painted wood* | *0.7* | *0.6* | *0.8* | *0.6* | *0.2* | | | |
| | | | | | | | | |
| **SILICA** | | | | | | | | |
| **Surface** | **200 S** | **270 S** | **400 S** | **-400 S** | | | | |
| Copper | 7 | 4 | 5 | 6 | | | | |
| Floor Tile | 1.5 | 0.5 | 2 | 2 | | | | |
| Formica - textured matte finish | 2.5 | 2 | 2 | 3 | | | | |
| Formica - smooth glossy finish | 2 | 2 | 2 | 2 | | | | |
| Glass | 0.5 | 1 | 0 | 0 | | | | |
| Glazed Ceramic Tile | 0 | 0 | 0 | 0 | | | | |
| Linoleum - textured glossy finish | 1 | 1 | 1 | 1 | | | | |
| Plastic light switch cover | 3 | 3 | 2 | 1 | | | | |
| Stainless Steel | 7 | 8 | 7 | 9 | | | | |
| Wood painted with Latex paint | 5 | 4 | 5 | 3 | | | | |
| *AVERAGE* | *3.0* | *2.6* | *2.6* | *2.7* | | | | |
| *AVERAGE w/o painted wood* | *2.7* | *2.4* | *2.3* | *2.7* | | | | |

Fig. 1

| CULLET | | | | | | |
|---|---|---|---|---|---|---|
| Strokes | 200 | 250 | 270 | 325 | +400 | -400 |
| 0 | 164 | 164 | 164 | 164 | 164 | 164 |
| 100 | 128 | 216 | 109 | 185 | 76 | 122 |
| 200 | 174 | 172 | 134 | 190 | 112 | 114 |
| 400 | 190 | 123 | 228 | 90 | 166 | 148 |
| 600 | 86 | 139 | 140 | 101 | 335 | 140 |
| 1000 | 234 | 141 | 387 | 188 | 174 | 500 |
| 1500 | 862 | 309 | 256 | 199 | 220 | 360 |
| | | | | | | |
| | | | | | | |
| | | | | | | |
| Silica | | | | | | |
| Strokes | 200 | 230 | 270 | +400 | -400 | |
| 0 | 164 | 164 | 164 | 164 | 164 | |
| 100 | 160 | 84 | 112 | 129 | 160 | |
| 200 | 131 | 91 | 124 | 138 | 158 | |
| 400 | 133 | 165 | 236 | 106 | 264 | |
| 600 | 306 | 146 | 543 | 112 | 807 | |
| 1000 | 515 | 265 | 880 | 380 | 604 | |
| 1500 | 596 | 734 | 1690 | 1638 | 1454 | |

Fig. 2

| Strokes | Water | Ajax | Comet | Bon Ami | Cullet | Kleen King | Old Dutch |
|---|---|---|---|---|---|---|---|
| 0 | 0 | 0 | 0 | 0 | 0 | 0 | 0 |
| 25 | 0 | 221 | 428.5 | 831.5 | 423.5 | 683.5 | 21 |
| 50 | 0 | 512 | 783 | 744.5 | 538.5 | 866.5 | 357 |
| 100 | 130 | 1120 | 1015.5 | 744.5 | 739.5 | 1155 | 696 |
| 200 | 95 | 1009 | 1043.5 | 1205 | 928.5 | 1109 | 695.5 |
| 400 | 468 | 1060 | 1493.5 | 1304 | 1082.5 | 1267 | 596.5 |

Fig. 3

| Strokes | Cullet: 3% Laponite | 4% Laponite | 1% Xanthum Gum/1% Laponite | 3% Xanthum Gum/1% Laponite | White Wizard | Power Paste | Water |
|---|---|---|---|---|---|---|---|
| 25 | 742 | 237 | 637 | 574 | 568 | 704 | 0 |
| 50 | 617 | 539 | 504 | 723 | 406 | 904 | 0 |
| 100 | 693 | 558 | 847 | 743 | 662 | 1096 | 130 |
| 200 | 898 | 1026 | 987 | 1104 | 621 | 1091 | 95 |
| 400 | 1006 | 1272 | 1097 | 1233 | 1073 | 1073 | 468 |

Fig. 4

| Strokes | Water | Ecover | SSS | Cullet | Soft Scrub | Shield |
|---|---|---|---|---|---|---|
| 50 | 239.5 | 1046 | 514.5 | 1021 | 696.5 | 998 |
| 100 | 322 | 1208 | 447 | 798 | 1180.5 | 1047.5 |
| 150 | 436 | 1016.5 | 703.5 | 1368.5 | 990 | 1157 |
| 200 | 128 | 1134.5 | 678 | 1155.5 | 1016.5 | 1167.5 |
| 400 | 128.5 | 1545 | 952.5 | 1449 | 1112.5 | 1134 |
| 600 | 487.5 | 1448.5 | 986.5 | 1676.5 | 1382.5 | 1246 |

Fig. 5

Coffee Mug Ceramic Testing

| Strokes | 5% Ceramic | 50% Ceramic | 100% Ceramic | 100% Cullet |
|---|---|---|---|---|
| 50 | 529 | 216 | 428 | 696 |
| 100 | 716 | 315 | 457 | 692 |
| 200 | 723 | 437 | 585 | 1066 |
| 400 | 817 | 459 | 368 | 988 |

Flourescent Light Ballasts Testing

| Strokes | 5% Ceramic | 50% Ceramic | 100% Ceramic | 100% Cullet |
|---|---|---|---|---|
| 50 | 198 | 107 | 416 | 696 |
| 100 | 412 | 148 | 256 | 692 |
| 200 | 519 | 227 | 454 | 1066 |
| 400 | 603 | 397 | 376 | 988 |

Fig. 6

ABRASIVE COMPOSITIONS INCLUDING CULLET

BACKGROUND OF THE INVENTION

1. Field of Invention

This invention generally relates to the field of abrasive cleaners and in particular to compositions that utilize cullet as an abrasive.

2. Description of the Related Art

Abrasive cleaners are used everyday in both industrial and residential applications. Powdered abrasive cleaners have long been known to be useful for scouring hard metallic materials, pots and pans, porcelain sinks, fixtures, and other hard surfaces that require high levels of mechanical abrasive for effective cleaning. Moreover, abrasives are commonly incorporated into health and beauty aids to clean or exfoliate "soft" surfaces, such as skin.

A wide variety of abrasive cleaner formulations exist, including powders, pastes, standard liquids, and thickened liquids or gel compositions. The typical abrasive cleaner contains, in addition to abrasive particles, surfactants, fillers, and a preservative. Optionally, cleaners may also contain, for example, bleaching agents, fragrances, deodorizing agents, and color additives. The abrasive materials most commonly employed in cleaner compositions are calcium carbonate, sodium carbonate, and water-insoluble siliceous materials, such as crystalline silica (including sand, feldspar, pumice, volcanic ash, diatomaceous earth, bentonite, talc and the like). Also useful as abrasives are ground nutshells, hardwood sawdust, synthetic abrasives, and mixtures thereof.

In general, the use of silica, feldspar, limestone or calcite (calcium carbonate) of various degrees of fineness has been preferred because of their hardness and the fact that they result in a white product. Nonetheless, the size, hardness, and shape of the particles may vary depending upon the particular scouring application.

Of those abrasives that have come to be preferred, "silica flour" has found particularly widespread use. The term "silica flour" defines pulverized crystalline silica of about 45 microns (325 mesh) to about 75 microns (200 mesh) in size. After crystalline silica is mined, it is milled to a fine powder of the indicated size and packaged for shipment. The silica then is used industrially as an abrasive cleanser and as an inert filler in a variety of consumer products ranging from toothpaste to metal polish.

One problem with the widespread use of silica and calcium carbonate is that they are mined as raw products from limited, non-renewable resources. Although the mining of abrasives is currently economically feasible, costs will increase as these products become more scarce. In addition, the environmental damage done by some mining practices creates further problems.

A more immediate threat caused by the mining and milling of any material containing crystalline silica is that workers may be exposed to adverse health risks, such as the inhalation of silica dust particles, which can result in silicosis. Silicosis is a debilitating respiratory disease that leads to fibrosis, a condition marked by the abnormal increase in fiber-containing (scar) tissue in the lungs.

The other ingredients found in many scouring cleaners or cleansers may also pose health and environmental risks. For example, many household cleaners contain chlorine in chemical forms such as sodium hypochlorite. These substances are highly corrosive and can damage the eyes, skin, and mucous membranes. Moreover, inhalation of chlorine can irritate the lungs, which is particularly dangerous for people with heart or respiratory conditions.

In terms of environmental damage, chlorine discharge can combine with other compounds to form dioxins and organochlorines.

Research has linked exposure to these substances with birth defects, cancer, and other reproductive and developmental disorders.

Therefore, there is a need for abrasive cleaners that effectively clean surfaces with ingredients that are replenishable, inexpensive, widely available, and inert or less harmful to human health or the environment then has previously been known.

SUMMARY OF THE INVENTION

The invention meets the aforementioned need by providing an effective abrasive cleaner that contains cullet as the main abrasive ingredient. The invention stems from the discovery that compositions ranging from 10–100% by weight of broken glass (cullet) having a size of about 150 microns or less in diameter effectively cleans common surfaces. Preferably, 20%–100% by weight of the cleaning product is cullet, with the cullet particles ranging in size from about 63 microns (230 mesh) to about 45 microns (325 mesh) for powder formulations, and about 45 microns (325 mesh) to 38 microns (400 mesh) for liquid and paste formulations. The preferred size ranges of cullet particles have been found to provide an especially desirable level of cleaning and scouring with little or no scratching. However, cullet particle sizes above and below the preferred ranges have been found to be effective abrasives.

Definitions

The term "abrasive" or "abrasives" includes any substance, alone or in combination, used to abrade, scrape, or rub away another substance, such as during the act of cleaning or polishing a surface.

The term "cullet" includes any type of broken refuse glass, such as, but not limited to, container glass (e.g. recyclable glass jars or bottles) of all colors, uncolored glass, plate glass (e.g. window panes), ceramic glass (e.g. coffee mugs), and mixtures thereof. For consistency throughout the specification, the use of the term "cullet," shall refer to broken recyclable container glass (uncolored, colored, or mixed) unless indicated otherwise. However, this definition is not meant to limit the invention to cullet of a particular glass composition.

As used in this description, the terms "mesh," "mesh size," "mesh value" or "mesh sieve size" generally are defined as the number of openings per inch of a sieve or screen. Since increasing the number of openings per inch in a sieve requires that the openings become smaller, an inversely proportional relationship exists between mesh value and the size of the particles passing through a given screen. In practice, mesh values can indicate either a wide range of cullet particle sizes (i.e. a given size or less) that pass through a particular sieve or a precise range of particle sizes. For example, if a cullet sample is screened only with a 200 mesh sieve, the particles that pass through would be 75 microns in diameter or less (down to sub-micron sizes). If, however, the 200 mesh cullet sample subsequently is screened with a 220 mesh sieve, all 200 mesh particles that do not pass through the 220 mesh sieve will be approximately 72–75 microns diameter. In this manner, a given mesh number may indicate particles of one or a few precise sizes or may indicate a wide range of sizes below a certain maximum size. Unless otherwise indicated, all mesh values cited in this disclosure represent cullet particles that have been precisely sized.

Especially preferred powder formulations of the invention contain cullet that is about 53 microns (270 mesh) in size, while liquid and paste formulations contain cullet of about 38 microns (400 mesh) in size. Also preferably, the inventive cleaner compositions are formulated to include sugar-based surfactants, a preservative, one or more fillers (e.g. clays, gums). An important advantage of the preferred formulations of the invention is that they are designed to use cullet and other ingredients that are less harmful to human health or the environment than most ingredients used in common commercial abrasive cleaners.

An object of this invention is to provide a high-quality abrasive cleaner made with cullet that has performance characteristics that are comparable or better than existing cleaners.

A second object of this invention is to provide an effective abrasive cleaner that is made from a renewable resource instead of from virgin raw materials that must be mined.

A third object of this invention is to provide a scouring composition that effectively cleans hard surfaces while avoiding the use or discharge of substances that can be harmful to human health or to the environment.

A fourth object of the invention is to provide an effective abrasive cleaner that is inexpensively produced using commonly-available materials.

A fifth object is to provide an abrasive cleaner that promotes the use of post-consumer, recycled glass.

A sixth object of this invention is to provide a cullet-based scouring composition that effectively cleans hard surfaces with a minimum of "scratching" damage to such surfaces.

A seventh object is to provide an abrasive cleaner including cullet that may be used to clean or abrade the skin.

The invention accomplishes these and other objects by providing novel and improved abrasive cleaners that include cullet.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments, and particularly pointed out in the claims. However, such drawings and description disclose only some of the various ways in which the invention may be practiced.

BRIEF DESCRIPTION OF THE DRAWINGS

FIG. 1 is a table of data showing results from scratch testing of various surfaces. The numerical data entries represent the degree of damage to a given surface, with 0 being no damage and 10 being the highest level of damage. Column indicators (e.g. 200C, 200S) represent either cullet (C) or silica (S) of a particular mesh size. The −400C. and −400S samples include all particles that are approximately 38 microns in diameter or less (down to the sub-micron level). The scrubbing process was carried out as described in the text.

FIG. 2 is a table of data showing the results of abrasiveness testing for cullet versus silica as described in the text.

FIG. 3 is a table of data showing the results of a comparative cleaning analysis for powder formulations of cullet versus commercial cleaners.

FIG. 4 is a table of data showing the results of a comparative cleaning analysis for paste formulations of cullet versus commercial cleaners.

FIG. 5 is a table of data showing the results of a comparative cleaning analysis for liquid formulations of cullet versus commercial cleaners.

FIG. 6 is a table of data showing the results of a comparative cleaning analysis for cullet of different composition, including two types of ceramic glass and container-glass cullet.

DETAILED DESCRIPTION OF THE INVENTION

The invention, in general, provides novel cleaner compositions made with cullet from various sources. The preferred inventive cleaning compositions were tested during research designed to discover new uses for recyclable-container cullet. In addition to cullet, the invention preferably includes the use of sugar-based surfactants, fillers, and preservatives to provide desirable and effective abrasive compositions.

The preferred formulations of the present invention have been found to provide remarkable cleaning performance, in some cases better than popular commercial products. This result was unexpected in that there had been no known investigation or documentation, prior to the invention described herein, of cleaning compositions made with cullet as the main scouring ingredient.

The use of cullet has been found to have many advantages over other abrasive cleaner ingredients. In terms of health consequences, fused silicates such as glass are amorphous, not crystalline like mined silica. Since the applicant is not aware of any association between respiratory disease and amorphous silica inhalation, the use of cullet is thought to minimize or eliminate the occurrence of silicosis.

Using cullet in cleaning compositions also is environmentally beneficial in two respects. First, its use avoids the pollution and depletion caused by the mining of non-renewable resources. Second, using cullet conserves landfill space by providing a market for waste glass that, ironically, is discarded into landfills even in areas which have successful recycling programs. The reason for this is economic in nature as many communities are losing money on their glass recycling programs because of low prices for overly-abundant waste glass and the comparatively high prices of cullet processing and transportation. This is especially true for mixed waste glass (e.g. mixtures of clear, brown, and green glass) and container glass that is contaminated with other types of glass, both of which have virtually no market value at present.

A further benefit of the invention is that it can be made from a widely available resource that is inexpensive to obtain. Based on EPA reports, approximately 12.5 million tons of glass containers (about 48 billion containers) were manufactured in the U.S. in 1998. However, generation of glass waste is actually greater than container manufacturing because of the importation of glass packaging for products such as wine or beer (0.7 million tons in 1998). With almost 7,000 glass recycling programs in the U.S. and prices for waste glass that range from pennies to about 40 dollars a ton, cullet is both cheap and plentiful.

Nonetheless, at present, cullet has a limited number of commercial applications. These applications essentially consist of use as a feedstock in glass manufacture, as a blasting material for removing paint from structure surfaces, and as a component of road aggregate, building material, or concrete.

However, these applications use relatively large sizes of cullet and consume only a minor fraction of the available waste glass produced. Thus, research was conducted to evaluate cullet as an abrasive in cleaning compositions.

Cullet Processing

Cullet is produced or processed using industrial mills to grind or crush the glass. The glass is then sized using screening techniques well known in the art to produce a final product consisting of a glass aggregate of random shapes in a particular size range. For instance, glass grinding may be accomplished by impact crushing or abrasion crushing. Impact crushing equipment is more durable and produces a more uniform shape. Abrasion crushing uses friction and compression to fracture material and includes equipment such as jaw crushers and cone crushers.

Many types of impact crushing equipment exist. The equipment normally used to produce cullet is similar to rock crushing equipment (e.g. hammermills, rotating breaker bars, rotating drum and breaker plate). Because glass crushing equipment has been primarily designed to reduce the size of cullet for transportation purposes and for use as a glass production feedstock material, the equipment is typically smaller and uses less energy than conventional aggregate or rock crushing equipment. Magnetic separation and air classification may also be required to remove any residual ferrous materials or paper still mixed in with the cullet.

One especially preferred means for producing cullet involves the use of so-called "hammer mills," which usually consist of a series of free swing bars (hammers) attached to pivots which are fixed to a rotating shaft. Bottles are broken by the swinging hammers and then discharged from the machine. The pivots help the hammers to transfer the impact energy to the glass while minimizing wear on the hammers. The glass is crushed or shattered by the repeated hammer impacts, by collisions with the walls of the grinding chamber, and by collisions among glass pieces.

Perforated metal screens, or bar grates covering the discharge opening of the mill, retain coarse glass for further grinding while allowing the properly-sized material to pass. Varying the screen size, shaft speed, or hammer configuration can dramatically alter the finished size of the product being ground. So, for example, faster speed, a smaller screen, and more hammers result in a finer end product. Each component can be changed individually or in any combination to produce the precise grind required.

If finely ground glass is unavailable commercially, one may use a ball mill to fine size cullet. A ball mill consists of cylindrical shells or chambers rotating on a horizontal axis mounted on a frame. The mill reduces the size of cullet by tumbling the cullet in a chamber with ceramic balls. The grinding medium and the cullet to be processed are loaded and discharged through openings in the chambers. During the tumbling process, balls follow complex trajectories impacting each other and the walls of the tumbling chamber. Glass particles are fractured during these collisions as they are caught between colliding surfaces. The ball charge consists of a distribution of different sizes to provide good packing, and optimal results are achieved with the chamber slightly over half full.

The highest efficiency is achieved when the chamber is rotated at the highest angular momentum possible without trapping balls against the walls with centrifugal forces. At proper speed, balls follow the rotation of the chamber (and other balls), up to a critical point where they fall under the action of gravity. The impact zone at the bottom of this fall is where most size reduction takes place.

One concern with this type of mill is the erosion of the ball media and chamber liner, resulting in contamination of the cullet. However, the rate of media/liner loss is engineered to be extremely low on the time-scale required for milling an individual batch. This is accomplished through the use of extremely hard, ceramic media and liners. Typically, aluminum oxide ceramics are used for both the grinding media and mill liner.

Cullet Cleaner Formulations

Cullet is an effective cleaner when simply made into a paste with a suitable carrier such as water, preferably in a 2:1 ratio (w/v). However, more preferably, cullet may be formulated with one or more surfactants, preservatives, or fillers, such as clays or gums (e.g. organic gums or organic thickeners such as xanthum gum), for enhanced cleaning performance. Optionally, fragrances, deodorizers (such as baking soda), bleaching agents, coloring agents, whiteners, softeners, conditioners, or disinfectants may be added for heightened consumer appeal.

Sugar-based surfactants are considered more environmentally safe than traditional synthetic surfactants, such as the anionic, nonionic, zwitterionic and cationic organic detergent surfactants. Surfactants are preferably included in the inventive compositions because they are thought to improve cleaning performance by lowering the surface tension of aqueous solutions in contact with the stain and cullet, thereby wetting the cullet particles and solubilizing the surface of a stain.

Clays, organic gums, or thickeners can indirectly enhance cleaning performance by contributing to the uniformity and/or viscosity of an abrasive suspension. In general, clays achieve this function by "thickening" or producing a colloid-forming mixture. Hence, mixed clay compositions are known to exhibit increased and prolonged fluidity upon application of shear stress and help the fluid retain a thickened state when flow is not desired. Preferably, the clay used in the invention is a synthetic colloidal clay. Unlike most natural clays, the synthetic clay used herein contains no free silica.

Similarly, organic gums help to increase viscosity, improve electrolyte tolerance, and otherwise stabilize an abrasive suspension. In general, the viscosity of a liquid cleaning composition is enhanced from a combination of the gum's salt content, inherent thickening properties, and protective colloidal structure.

Optionally, a bleaching agent is included in the invention. This agent can be any of a large number of organic or inorganic compounds that release oxygen, chlorine or hypohalite when combined with water. Examples include, but are not limited to, alkali metal perborates, N-chloro-cyanurates, and halogenated hydantoins. Non-cholorine bleach is preferred because it provides whitening and disinfection with less corrosive properties and with less chemically-active discharge.

The addition of a bleaching agent or any other optional ingredient to the cullet-based cleaner depends on the particular cleaning applications. Baking soda partially absorbs odors from stains, as well as from other cleaner ingredients, and aids in loosening soil. Although cullet can be obtained that is odor-free, a fragrance can be used to mask any natural smell of the cullet (or other ingredients) or to provide a "clean" smell for the user. Similarly, a coloring agent can be used to change the natural color of the cullet composition, which typically is a pleasant green color, but depends on the percentages of blue, green, amber, or flint glass used (in a mixed cullet preparation). Finally, a natural preservative, such as Citricidal™, in a liquid or paste embodiments prevents microbial growth.

Although the inventive compositions have been found to be effective abrasive cleaners when containing between 10% to 100% by weight of cullet, the preferred ranges of ingredients for the most common formulations (e.g. powders, liquids, pastes, etc.) include:

Powders (% by Weight)

1–2% Glucopon™425N—a sugar-based surfactant

88–99% cullet

0–10% sodium bicarbonate

Liquids(% by Weight)

1–2% Laponite™RD—a synthetic colloidal clay

1–2% Glucopon™

35–40% cullet

0–0.5% xanthum gum 0.01% Citricidal™ preservative (a grapefruit extract)

57.49–64% water

Pastes(% by Weight)

0–4% Laponite™

1–2% Glucopon™

35–40% cullet

0–3% xanthum gum 0.01% Citricidal™ preservative

51–64% water

Although not preferred, cullet particles utilized with the invention may range in size from between 100 to about 150 microns in diameter before difficulties, such as separation (in solutions), diminished abrasive effectiveness, or surface damage, become problematic. Preferably, cullet ranging in size from about 25 microns (or lower as long as abrasive effect can be shown without significant surface damage) to about 75 microns in diameter is employed. Especially preferred particle sizes and formulations for a cullet cleaning compositions of the invention are as follows:

Powder Embodiment (w/w)

89% cullet of 53 microns to 63 microns in size;

1% Glucopan™; and

10% baking soda ($NaHCO_3$)

Liquid Embodiment (w/w)

1% Laponite™

1% Glucopon™

40% cullet (by weight) of 38 microns or less in size 0.5% xanthum gum 0.1% Citricidal™ preservative 57.49% water Pastes(w/w)

Formulation 1

1% Laponite™

1% Glucopon™

40% cullet (by weight) that is 45 to 38 microns in size

3% xanthum gum 0.01% Citricidal™ preservative 54.99% water

Formulation 2

4% Laponite™

1% Glucopon™

40% cullet that is 45–38 microns in size 0.01% Citricidal™ preservative 54.99% water Solid (soaps) or gelatinous cleaners may also be produced for specialized abrasion applications, such as hand washing and/or skin exfoliation. For example, a soap may be formulated to include:

| Ingredient | Percentage by Weight |
|---|---|
| Water | 20 |
| NaOH | 8 |
| Olive Oil | 19 |
| Fat (tallow, etc.) | 44 |
| Cullet | 10 |
| Fragrance | Trace |
| Colorant | Trace |

Furthermore, it is contemplated that cullet may be added to a wide range of consumer products in which a mild abrasive action is desirable, such as in toothpastes and polishes.

Tests of Cullet Cleaning Performance

Description of Equipment and Procedure

To conduct scrub testing, a scrubbing machine was designed so as to minimize any inconsistencies in scrubbing patterns, strength, and stroke number. The machine employs a variable speed motor with a base and two scrubbing arms. The surface to be scrubbed was affixed to the base by various means depending on the surface type. A felt pad was attached to the scrubbing arm with spray glue.

A typical test using the scrubbing machine proceeded as follows: The cleaner was placed on the surface to be scrubbed. Each scrubbing arm was fitted with a tray to hold 4 pounds of weight for applying pressure to the surface, with the motor set to constant speed. The scrubbing arm used a back-and-forth motion to clean the surface. Thus, a stroke was defined as the movement of the arm in one direction, so one time back-and-forth was counted as two strokes. A felt pad was chosen over traditional scrubbing pads to minimize any abrasiveness resulting from the pad rather than the cleaner. The pad was changed after each test.

For the quantitative evaluation of scrubbing results, a computer controlled, in-house designed, optical instrument was used. Diffuse light from four light emitting diodes was directed toward the sample to be evaluated. The instrument evaluated the amount of stain removed by measuring the light reflected from the sample to a detector (with results displayed millivolts). Thus, the higher the millivolt value, the more the stain had been removed. Each sample was measured ten times with the average value used in subsequent calculations. The percent standard deviation of measurements was approximately 1.5%.

Cullet samples were obtained from TRIVITRO Corporation, Kent, Wash., and fine-sized to the described mesh values by METCON Research, Inc, Tucson, Ariz. Samples were inspected for large pieces, organic contaminants and metal pieces to make certain that the scouring properties tested could be attributed to the cullet. To ensure sample integrity and safety, the cullet also was subjected to analysis for toxic metal content, particle distribution, moisture, radioactivity, and percent crystalline silica. The results showed that the TRIVITRO Corporation glass contained no detectable levels of any of the substances tested for and was comparable to commercial abrasive in terms of moisture and particle distribution.

Abrasiveness of Silica Versus Cullet—Scratch Testing

Scratch testing of a variety of surfaces was performed to aid in choosing an optimal size of cullet for additional testing. Preliminary experiments showed that sizes larger than 75 microns were not preferred because the cullet particles were too large and unwieldy (e.g. they separated out of solution) for use in a cleaner and/or scratched the tested surfaces. Thus, most of the comparative testing was performed with cullet and silica mesh sizes that included particles of less than 75 microns in size.

Ten common surfaces were tested with silica and cullet of various sizes as indicated in FIG. 1. Each surface was scrubbed 100 times with the scrubbing machine. Five grams of a 2:1 (w:w) mixture of the pure substance (silica or cullet) and water were used. After scrubbing, the surface was washed, dried, evaluated with a hand lens and by the naked eye for scratching, and scored from 0 to 10. A score of zero indicates no scratching while ten indicates a great deal of scratching. As demonstrated by the results given in FIG. 1, all sizes of silica scratched more than the comparable size of cullet.

Additional testing of the abrasiveness of silica versus cullet was performed. Ceramic tiles were spray painted with flat red paint, and, after air drying, spray painted with flat black paint. The tiles were weighed before and after each painting to determine the amount of paint applied. Ceramic tiles were chosen because they are a hard surface not easily damaged by abrasive cleaners. Two colors were chosen to gage the degree of removal of paint, with the red paint and/or the white color of the tile serving as indicators.

The tiles were scrubbed with formulations of 2% surfactant, 10% sodium bicarbonate and 88% cullet or silica. Five grams of a 2:1 (w:w) mixture of each formulation were used for scrubbing. For each formulation, individual tiles were scrubbed 100, 200, 400, 600, 1,000 and 1,500 strokes, respectively. The effect of the scrubbing on the surface of the tiles was evaluated optically as shown for a particular size of cullet or silica in FIG. 2, with larger millivolt readings indicating more damage to the tested surface. Again, practically all sizes of silica scratched more than the comparable size of cullet for a given number of strokes. These test results also confirmed the preliminary scratch tests discussed above, which indicated that cullet sized 75 microns (200 mesh) or greater was more abrasive than the other sizes of cullet tested.

Comparison to Commercial Cleaners

Automated scouring tests showed that cullet cleaners were comparable or better than several commercial cleaning products (See FIGS. 3, 4, and 5). To facilitate more uniform comparisons, the tests were broken down into products of three general types: powders, liquids, and pastes. The tested cullet formulations were based on the preferred embodiments as described above, while commercial cleaners were used as supplied by the manufacturer.

The commercial cleaners tested were: (1) Powders—Ajax with Bleach®, Comet with Bleach®, Kleen King™, Old Dutch Cleanser with Bleach®, and Bon Ami®; (2) Liquids—Soft Scrub® with bleach, N-L Cream™ Cleanser, Ecover™ Natural Cream Scrub, SSS® Liquid Scouring Creme, Shield® Preclean 2000; and (3) Pastes—White Wizard™ and Power Paste™. The abrasive material used in the commercial cleaners is as follows:

| Cleaner | ABRASIVE |
|---|---|
| Ajax with Bleach ® | calcium and sodium carbonate |
| Bon Ami ® | calcium carbonate |
| Comet with Bleach ® | calcium and sodium carbonate |
| Ecover ™ Natural Scrub | ground chalk |
| Kleen King ™ | (unlisted; calcium carbonate?) |
| N-L Cream ™ Cleanser | silica sand (CAS # 7631-86-9) and caustic potash (sodium carbonate) |
| Old Dutch w/Bleach ® | silicon dioxide & sodium carbonate |
| Power Paste ™ | silica flour |
| Shield ®Preclean 2000 | silica (CAS # 14808-60-7) |
| Soft Scrub ®with bleach | sodium carbonate |
| SSS ®Liquid Creme | (unlisted; calcium carbonate?) |
| White Wizard ™ | (unlisted; calcium carbonate?) |

The sample surfaces tested were smooth blocks of wood painted with a black, flat, water-based paint. This stain was chosen because it could be applied uniformly and smoothly to the surface of the block, and it was moderately easy to remove with abrasive cleaners. Other stains evaluated were grease, crayon, dye, asphalt sealer, permanent marker, and black shoe polish. These stains were not chosen because they were difficult to apply, they resulted in a rough surface, or they were too difficult or too easy to remove.

The blocks were not scrubbed long enough to reach the bare surface. However, as scrubbing progressed, the white felt pad slowly shifted from all white (reflecting light) to black (absorbing light). Thus, the optical instrument measured the amount of stain on the pad. To take into account variations in color from the cleaners, the data were normalized by subtracting the results from the results from scrubbing with the cleaner and pad but no stain. This gave the change in color from stain removal and not from the cleaner staining the felt pad.

Turning to the data for powders presented in FIG. 3, five grams of a 2:1 (w:w) mixture of the cullet or commercial formulations and water were used for scrubbing. For each formulation, individual samples were scrubbed 25, 50, 100, 200 and 400 strokes, respectively. The amount of stain removed was evaluated optically as described above, with larger output (in millivolts) indicating that more stain had been removed. The cullet formulation performed similarly to Ajax®, better than Old Dutch® and comparably to, but not quite as well as, Comet®, Bon Ami® and Kleen King™.

Cleaner Side Effects: Scratching, Discoloration, or Dulling

To compare the side effects of cullet and commercial cleaners, five grams of a 2:1 (w:w) mixture of the formulations and water were used for scrubbing. Surfaces tested were copper, stainless steel, formica MF (matte finish), and formica SF ("sparkle" finish). For each formulation, individual samples were scrubbed 100 strokes. After scrubbing the surface was washed, dried, evaluated with a hand lens and by eye for scratching, discoloration or dulling and scored from 0 to 10. A score of zero indicates no scratching, discoloration or dulling while ten indicates a great deal of surface damage. Cullet outperformed the other cleaners as shown in Table 1:

TABLE 1

| Average | Copper | Stainless Steel | Formica MF | | Formica SF |
|---|---|---|---|---|---|
| Ajax ® | 2 | 2 | 1 | 0 | 1.3 |
| Bon Ami ® | 4 | 4 | 2 | 0 | 2.5 |
| Cullet | 1 | 1 | 0 | 0 | 0.5 |
| Comet ® | 2 | 3 | 3 | 1 | 2.3 |

TABLE 1-continued

| Average | Copper | Stainless Steel | Formica MF | | Formica SF |
|---|---|---|---|---|---|
| Kleen King ™ | 6 | 8 | 5 | 3 | 5.5 |
| Old Dutch ® | 3 | 6 | 5 | 3 | 4.3 |

As is evident from the data above, some cleaners may remove stains well but leave the surface discolored, scratched or stained. For example Kleen King™ may remove the stain well but it left surfaces dull, discolored or scratched. To correlate stain removal and surface scratching, discoloration and dulling, the average score from scratch testing was normalized with the rank of the cleaner at 100 strokes from the stain removal testing to give an overall cleaning score. The higher the rank from the stain removal testing, the better the stain was removed. The lower the overall cleansing score, the better the cleaner performed taking both tests into consideration. As shown in Table 2 below, cullet performed similarly to Ajax® and outperformed the other cleaners:

TABLE 2

| | Overall Cleansing Score | |
|---|---|---|
| Cleaner | Rank at 100 Strokes | Overall Cleansing Score |
| Ajax ® | 5 | 0.3 |
| Bon Ami ® | 2 | 1.3 |
| Cullet | 2 | 0.3 |
| Comet ® | 4 | 0.6 |
| Kleen King ™ | 6 | 0.7 |
| Old Dutch ® | 1 | 4.3 |

Turning to the data for liquid and paste tests in FIGS. 4 & 5, five grams of pastes and liquids as supplied by the manufacturer were used for scrubbing. For each paste formulation, individual samples were scrubbed 25, 50, 100, 200 and 400 strokes respectively. For each liquid formulation, individual samples were scrubbed 50, 100, 150, 200, 400 and 600 strokes respectively. The amount of stain removed was evaluated optically as described above. Again, the data indicate that the cullet formulations performed better or comparable to the commercial cleaners.

Additional Testing on "Real-Life" Stains

Informal testing with cullet-based cleaners on "real-life" stains in home environments has confirmed the laboratory results described above. Surfaces, including aluminum and glass pans with baked on stains, cement stained with paint, and a fiberglass bathtub harboring soap and oil residue, were scrubbed using a sponge with Ajax®, Comet®, Ecover® or a cullet paste prepared as described herein. After the same number of scrubbing strokes for both cleaners, the surfaces were rinsed and visually compared to identify any dissimilarities in cleaning ability. This comparison demonstrated that the cullet paste cleaned as well as or better than the other cleaners.

Tests with Cullet Made from Ceramic or Plate Glass

Different types of waste glass are commonly broken and commingled. This is a problem because, for example, container glass contaminated with ceramic or plate glass cannot be economically recycled due to melting difficulties. Thus, it was of interest to determine whether or not cullet containing some amount of ceramic or plate glass (or, indeed pure ceramic or plate glass) could be utilized as an abrasive cleaner.

For the ceramic glass testing, two types of glass (old coffee mugs and light ballasts) were ground to the same mesh as container-glass cullet (38 microns). Each type of glass was then used alone (100%) and mixed, either 50%:50% or 95%:5% container-glass cullet:ceramic, and tested for surface scratching and cleaning ability. The percentages were chosen based on advice from staff from Trivitro Corporation in Kent, Wash. Loads of glass are rarely contaminated more than 5%, but that amount makes them unusable for the glass container industry. Five grams of a 2:1 (w:w) mixture of the formulations and water were used for scrubbing. For each formulation, individual samples were scrubbed 50, 100, 200, and 400 strokes respectively.

The amount of stain removed was evaluated optically as shown in FIG. 6. Based on the results in FIG. 6, although not as effective as container glass, ceramic glass can be used as an abrasive cleaner. Moreover, scratch testing results were comparable for all types of glass tested. Additional tests with plate glass instead of ceramic gave similar results to those conducted with ceramic (data not shown).

Overall, the data described herein demonstrate that cullet performs favorably in relation to the abrasive already used in commercial products. Moreover, the laboratory tests confirm the qualitative observations of the human evaluators during in-home testing and indicate that container-glass cullet contaminated with about 5% ceramic or plate glass is comparable or superior in cleaning effectiveness to available abrasive cleaners for most stains and surfaces. Moreover, even cullet made completely from plate or ceramic glass provides at least some abrasive cleaning ability.

As would be understood by those skilled in the art, any number of functional equivalents may exist in lieu of the preferred embodiments described above. Thus, as will be apparent to those skilled in the art, changes in the details and materials that have been described may be within the principles and scope of the invention illustrated herein and defined in the appended claims.

Accordingly, while the present invention has been shown and described in what is believed to be the most practical and preferred embodiments, it is recognized that departures can be made therefrom within the scope of the invention, which is therefore not to be limited to the details disclosed herein but is to be accorded the full scope of the claims so as to embrace any and all equivalent products.

We claim:

1. An abrasive cleaner composition including at least 10% cullet by weight, wherein about 90% or more of said cullet is about 150 microns or less in diameter, and wherein the cleaner further includes an effective amount of a surfactant.

2. The cleaner of claim 1, wherein the cullet is selected from the group consisting of container glass, plate glass, ceramic glass, or combinations thereof.

3. The cleaner of claim 1, wherein the surfactant is a sugar-based surfactant.

4. The cleaner of claim 1, further including an effective amount of a clay.

5. The cleaner of claim 4, wherein the clay is a synthetic colloidal clay.

6. The cleaner of claim 1, further including an effective amount of a gum.

7. The cleaner of claim 6, wherein the gum is an organic gum.

8. The cleaner of claim 1, further including an effective amount of a preservative.

9. The cleaner of claim 8, wherein the preservative is Citricidal.

10. The cleaner of claim 1, further including an effective amount of an optional ingredient selected from the group consisting of fragrances, coloring agents, deodorizing agents, whiteners, softeners, conditioners, disinfectants, bleaching agents, and combinations thereof.

11. A method of cleaning a surface with an abrasive cleaner, comprising the steps of:

(a) applying an abrasive cleaner to the surface, said cleaner including at least 10% cullet by weight, wherein about 90% or more of said cullet is about 150 microns or less in diameter, said cleaner further includes an effective amount of a surfactant, an (b) abrading said surface with said abrasive cleaner.

12. The method of claim 11, wherein the cullet is selected from the group consisting of container glass, plate glass, ceramic glass, or combinations thereof.

13. The method of claim 11, wherein said surfactant is a sugar-based surfactant.

14. The method of claim 11, wherein said cleaner further includes an effective amount of a clay.

15. The method of claim 14, wherein the clay is a synthetic colloidal clay.

16. The method of claim 11, wherein the cleaner further includes an effective amount of a gum.

17. The method of claim 16, herein the gum is an organic gum.

18. The method of claim 11, wherein the cleaner further includes an effective amount of preservative.

19. The method of claim 18, wherein the preservative is Citricidal.

20. The method of claim 11, further including an effective amount of an optional ingredient selected from the group consisting of fragrances, coloring agents, deodorizing agents, whiteners, softeners, conditioners, disinfectants, bleaching agents, and combinations thereof.

21. An abrasive cleaner composition, comprising:

at least 10% by weight of cullet particles in a suitable carrier, wherein about 90% or more of the cullet particles are about 150 microns or less in diameter, said cleaner further includes an effective amount of a surfactant.

22. The cleaner composition of claim 21, wherein the suitable carrier is water.

* * * * *